US007447448B2

(12) United States Patent
Uchida

(10) Patent No.: US 7,447,448 B2
(45) Date of Patent: Nov. 4, 2008

(54) OPTIONAL APPARATUSES EACH DISPLAYING UNIQUE IDENTIFIER AND IMAGE FORMING APPARATUS CONTAINING SAME

(75) Inventor: Yasuhiro Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 11/535,709

(22) Filed: Sep. 27, 2006

(65) Prior Publication Data

US 2007/0036561 A1 Feb. 15, 2007

Related U.S. Application Data

(62) Division of application No. 10/893,353, filed on Jul. 19, 2004, now Pat. No. 7,130,548.

(30) Foreign Application Priority Data

Jul. 24, 2003 (JP) ..... 2003-201087

(51) Int. Cl.
*G03G 15/00* (2006.01)

(52) U.S. Cl. ..... 399/12; 399/13

(58) Field of Classification Search ..... 399/9, 399/12, 13, 16, 23, 391; 271/9.01, 9.07, 271/9.08, 9.11
See application file for complete search history.

(56) References Cited

U.S. PATENT DOCUMENTS

| | | | | |
|---|---|---|---|---|
| 5,311,270 | A | 5/1994 | Urakawa | 399/12 |
| 5,610,724 | A | 3/1997 | Kaneko et al. | 358/400 |
| 5,765,826 | A | 6/1998 | Isoda et al. | 271/162 |
| 5,975,515 | A | 11/1999 | Capri et al. | 271/9.11 |
| 6,643,480 | B2 | 11/2003 | Kuwata et al. | 399/107 |
| 7,027,765 | B2 * | 4/2006 | Han | 399/391 |
| 7,043,168 | B2 * | 5/2006 | Arakawa | 399/12 |
| 2003/0057634 | A1 | 3/2003 | Matsushima et al. | 271/117 |
| 2003/0080497 | A1 | 5/2003 | Matsushima et al. | 271/171 |
| 2004/0041333 | A1 | 3/2004 | Izumi et al. | 271/145 |

FOREIGN PATENT DOCUMENTS

| | | |
|---|---|---|
| JP | 10-231027 | 9/1998 |
| JP | 11-246059 | 9/1999 |

* cited by examiner

*Primary Examiner*—Hoan H Tran
(74) *Attorney, Agent, or Firm*—Fitzpatrick, Cella, Harper & Scinto

(57) ABSTRACT

Each of a plurality of connected optional apparatuses includes a sliding member slidable in a direction of connection, and a display provided in the sliding member, the display having a plurality of unique identifiers. The sliding member is movable while contacting a sliding member of an adjacent one of the plurality of optional apparatuses, and when the plurality of optional apparatuses are connected, a moving amount of a sliding member of each of the plurality of optional apparatuses differs, and therefore displays a different unique identifier.

10 Claims, 8 Drawing Sheets

OPTIONAL APPARATUSES EACH DISPLAYING UNIQUE IDENTIFIER AND IMAGE FORMING APPARATUS CONTAINING SAME

This application is a divisional of U.S. patent application Ser. No. 10/893,353, filed Jul. 19, 2004, and allowed Aug. 24, 2006.

BACKGROUND OF THE INVENTION

1. Field of the Invention

The present invention relates to a plurality of connected optional apparatuses, such as external sheet feeding apparatuses or external sheet discharging apparatuses, that are connected to an image forming apparatus, and to an image forming apparatus, such as a copier, a facsimile apparatus, and a printer, that can be connected to the optional apparatuses.

2. Description of the Related Art

An image forming apparatus is often configured to increase a sheet feeding capacity and a discharged-sheet mounting capacity by including a plurality of external sheet feeding apparatuses, such as optional feeders, or external sheet discharging apparatuses, such as optional trays, connected to the image forming apparatus. Such external apparatuses (hereinafter termed "optional apparatuses") are generally disposed below or above an image forming apparatus. In many cases, optional apparatuses can be stacked in several stages.

In an image forming apparatus connecting to these optional apparatuses, discrimination among the optional apparatuses is generally performed by providing each of the optional apparatuses with an identifier, such as a sheet-feeding-port number in an external sheet feeding apparatus, or a discharged-sheet-tray number in an external sheet discharging apparatus. That is, each optional apparatus is discriminated by being provided with an identifier, such as a numeral, a letter, or the like.

Conventionally, when there is an identifier for each optional apparatus when a plurality of optional apparatuses are used in a stacked state, for example, the process of attaching a label on which a corresponding identifier is printed is performed after installing an optional apparatus, and as a result the operation of installing optional apparatuses becomes complicated.

In order to solve such a problem, Japanese Patent Application Laid-Open (Kokai) No. 11-246059 (1999) discloses a configuration for allowing automatic switching of an identifier for a connected optional apparatus.

This conventional configuration will be described illustrating optional feeders, serving as external sheet feeding apparatuses. As shown in FIG. 8, a sliding member 4 having an projection 9 protruding upward is provided so as to be vertically slidable in each optional feeder 2. The sliding member 4 is urged upward by a coil spring 7. Two identifiers "2" and "3" are integrally formed on the sliding member 4 at constant intervals in a sliding direction. When optional feeder 2 is in one stage, the identifier "2" disposed downward from among the two identifiers is displayed from a display window 8 provided in the surface of a protective housing of the optional feeder 2. A hole 11 in image forming apparatus 1 is provided at a position facing the projection 9 of the sliding member 4 of the uppermost optional feeder 2. When connecting the uppermost optional feeder 2 to the lower surface of an image forming apparatus 1, the projection 9 is inserted into the hole 11. Since the sliding member 4 does not move, the identifier of the optional feeder 2 is a sheet-feeding-unit number "2" provided at the lower portion of the sliding member 4.

Since the base of the optional feeder 2 is flat, when an optional feeder 2 of the second stage is connected below the uppermost or first optional feeder 2, the projection 9 of the lower optional feeder 2 contacts the base of the uppermost optional feeder 2 to push the sliding member 4 downward against the spring force of the coil spring 7. As a result, the identifier "3" provided at the upper portion of the sliding member 4 is displayed thru display window 8 provided on the surface of the protective housing, to set the sheet-feeding-unit number of the lower optional feeder 2 to "3".

In the above-described conventional configuration, however, since switching of the identifier is performed using the optional apparatus disposed adjacent to the first optional apparatus and switching can be performed only between two types of identifiers, it is impossible to deal with a configuration allowing stacking of at least three external sheet feeding apparatuses.

SUMMARY OF THE INVENTION

It is an object of the present invention to provide a sheet feeding apparatus that allows automatic switching of a peculiar display even in optional apparatuses that can be stacked at least to three stages.

According to one aspect of the present invention, each of a plurality of connected optional apparatuses includes a sliding member slidable in a direction of connection, and a display member connected to the sliding member. The display member contains a plurality of unique identifiers. The sliding member is in contact with a sliding member of an adjacent one of the plurality of optional apparatuses. When the plurality of optional apparatuses are connected, a moving amount of the sliding member of each of the plurality of optional apparatuses differs from each other of the plurality of optional apparatuses, thereby displaying a different unique identifier of the display member of each optional apparatus.

According to another aspect of the present invention, an image forming apparatus includes a main body of the image forming apparatus, and the above-described optional apparatuses.

The foregoing and other objects, advantages and features of the present invention will become more apparent from the following description of the preferred embodiments taken in conjunction with the accompanying drawings.

DESCRIPTION OF THE PREFERRED EMBODIMENTS

First Embodiment

The configuration of an image forming apparatus including sheet feeding apparatuses according to a first embodiment of the present invention will now be described.

Figure 3:
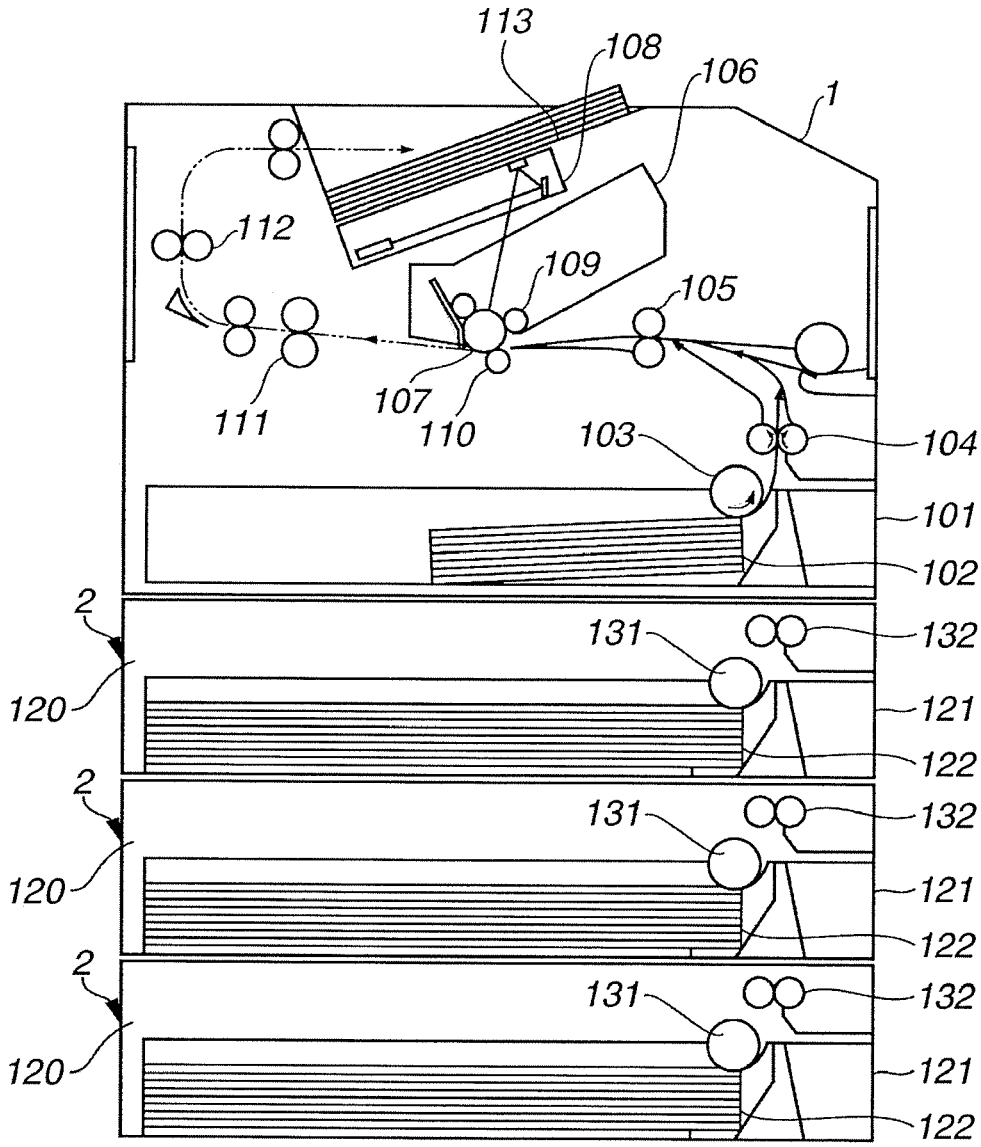
FIG. 3 is a cross-sectional view illustrating the image forming apparatus and the optional apparatuses according to the first embodiment.

In FIG. 3, a sheet feeding cassette 101 is detachably provided within an image forming apparatus 1. A central plate 102 for mounting sheets is provided within the sheet feeding cassette 101, and is urged upward by a spring (not shown). A pickup roller 103 for feeding sheets mounted on the central plate 102 is provided in the image forming apparatus 1. A sheet fed by the pickup roller 103 is conveyed to registration rollers 105 by a pair of conveying rollers 104.

An image forming portion includes a process cartridge 106 including a photosensitive drum 107, serving as an image bearing member, a developing roller 109, an optical unit 108 for irradiating a laser beam modulated by image information, and fixing means 111. The sheet on which an image is formed by the image forming portion is conveyed by a pair of conveying rollers 112 to a discharged-sheet tray 113 which is disposed at an upper portion of the image forming apparatus 1.

Optional feeders 2, serving as optional apparatuses of the present invention, are connected in multiple stages (three stages in the first embodiment) below the image forming apparatus 1. Each of the optional feeders 2 has a feeder main body 120 and a sheet feeding cassette 121 provided so as to be detachable with respect to the feeder main body 120.

A central plate 122 for mounting sheets is provided in the sheet feeding cassette 121, and is urged upward by a spring (not shown). The feeder main body 120 includes a pickup roller 131 for feeding sheets mounted on the sheet feeding cassette 121, and a pair of conveying rollers 132. The sheet is conveyed by the pair of conveying rollers 132 toward the registration rollers 105 of the image forming apparatus 1. The optional feeders each have the same configuration, and can be replaced or exchanged.

An outline of operations of the image forming apparatus 1 will now be described.

An electrostatic latent image is formed on the photosensitive drum 107 according to an electrophotographic method by projecting a laser beam from the optical unit 108. By causing a toner, serving as a developer, to adhere to the photosensitive drum 107 on which the electrostatic latent image has been formed, using the developing roller 109, the latent image is developed to become a toner image.

A sheet fed from the sheet feeding cassette 101 within the image forming apparatus 1, or from the sheet feeding cassette 121 within one of the optional feeders 2, is conveyed to the pair of registration rollers 105, and is fed at a timing in which the sheet is aligned with the position of an image on the photosensitive drum 107 by the pair of registration rollers 105. The toner image on the photosensitive drum 107 is transferred onto the fed sheet by a transfer roller 110. Then, the sheet is conveyed to the fixing means 111, where the toner image is heated and fixed on the sheet. The sheet after image fixing is discharged onto the discharged-sheet tray 113 by the pair of conveying rollers 112.

Figure 1:
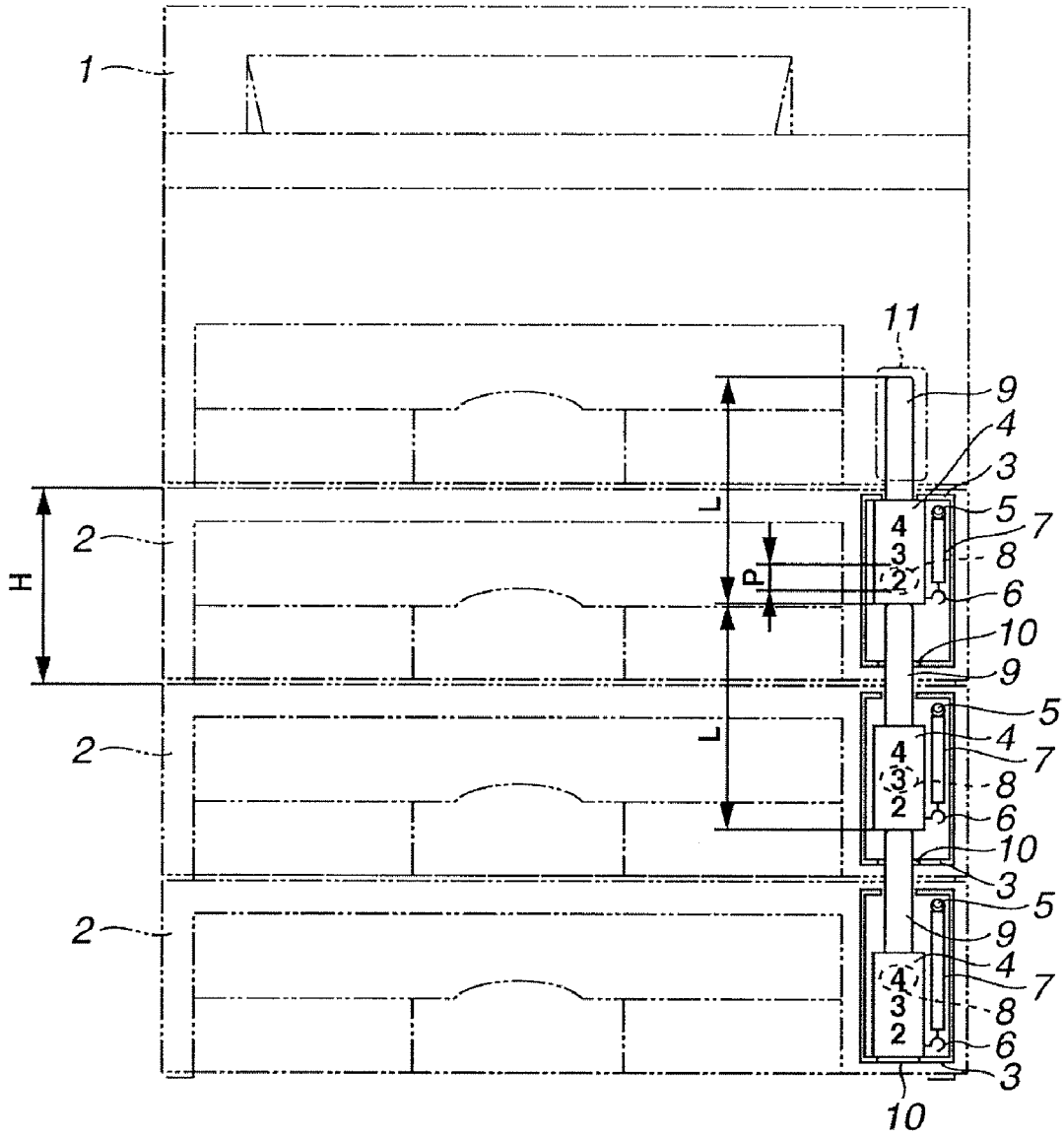
FIG. 1 is a cross-sectional view illustrating unique numeric identifier units of an optional apparatus according to a first embodiment of the present invention.
Figure 2:
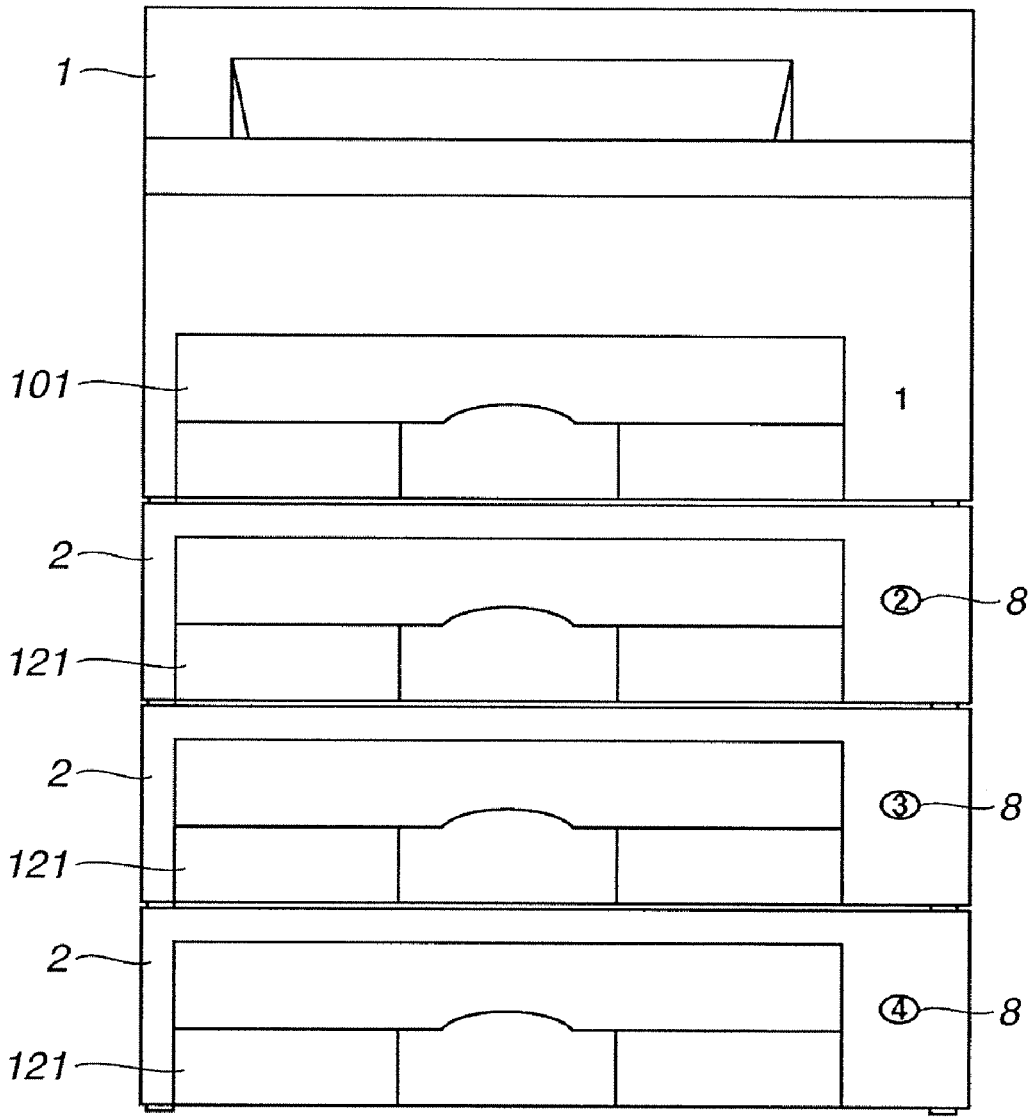
FIG. 2 is a front view illustrating an image forming apparatus and the optional apparatuses according to the first embodiment.

The first embodiment will now be described in detail with reference to FIGS. 1 and 2. FIG. 1 is a cross-sectional view illustrating unique-number display units of optional feeders, serving as optional apparatuses. FIG. 2 is a front view when the optional feeders are connected to the image forming apparatus 1.

A first optional feeder 2 is connected to the image forming apparatus 1 by mounting the image forming apparatus 1 on the optional feeder 2 by adjusting the relative position between positioning pins (not shown) provided on the upper surface of the optional feeder 2 and reference holes (not shown) provided in the base of the image forming apparatus 1. Reference holes are also provided in the base of the first optional feeder 2 as in the image forming apparatus 1, so that another optional feeder 2 can be connected by being superposed on the lower surface of the first optional feeder 2. A character "1" indicating the sheet-feeding-unit number of the sheet feeding cassette 101 is marked on the surface of the protective housing near the sheet feeding cassette 101 provided in the image forming apparatus 1.

Next, the configuration and the operation of the unique-number display unit of the optional feeders 2 will be described with reference to FIG. 1.

A sliding member 4 is held on a display base 3 fixed on the frame of optional feeder 2 so as to be vertically slidable. The sliding member 4 includes a display unit in which three characters "2", "3" and "4", serving as unique displays indicating the numbers for the sheet feeding units of the optional feeders 2, are arranged in the sliding direction of the sliding member 4 at constant intervals P, and a projection 9 upwardly formed from the display unit.

One end of a coil spring 7 provided in parallel to the sliding member 4 is connected to a boss 5 integrally formed on the display base 3, and another end of the coil spring 7 is engaged with a hook 6 integrally formed on the sliding member 4 to urge the sliding member 4 upward in the plane of FIG. 1. At that time, the sliding member 4 is positioned by contacting an upper portion of the display base 3. In this state, the number "2" is displayed in a display window 8 formed on the surface of the protective housing of the optional feeder 2.

The projection 9 of the sliding member 4 protrudes from an upper portion of the optional feeder 2. A hole 10 through which the projection 9 can be inserted is provided in the base of the optional feeder 2 and the lower surface of the display base 3 at a position facing the projection 9 of another optional feeder 2 disposed below the first optional feeder 2. When the lower second optional feeder 2 is connected, the projection 9 of this optional feeder 2 is inserted into the hole 10 of the upper optional feeder 2, so that the lower optional feeder 2 can contact the lower surface of the sliding member 4 of the upper first optional feeder 2.

The length L from the upper end of the projection p to the lower end of the sliding member 4 is set so as to satisfy the following equation:

$$L=H+P \quad (1),$$

where P is the interval between adjacent peculiar displays, and H is the height of the optional feeder 2.

A hole 11 through which the projection 9 can be inserted is provided in the base of the image forming apparatus 1 at a position facing the projection 9 protruding from the first optional feeder 2. Since the projection 9 of the sliding member 4 of the optional feeder 2 on the upper surface of which the image forming apparatus 1 is placed is completely inserted into the hole 11 of the image forming apparatus 1, the sliding member 4 does not move. Accordingly, the unique display "2" is displayed in the display window 8 of the optional feeder 2.

When connecting two optional feeders 2, the projection 9 of the lower optional feeder 2 enters the hole 10 of the first optional feeder 2 and contacts the lower surface of the upper sliding member 4, whereby the projection 9 is pressed downward against the spring force of the coil spring 7. In the case of the second optional feeder 2, i.e., the optional feeder 2 connected below the first optional feeder 2 placed below the image forming apparatus 1, the moving amount of the sliding member 4 equals P (one pitch of the unique number on the sliding member 4) from the above-described equation (1). Accordingly, the unique display "3" is displayed in the display window of the second optional feeder 2.

In the case of the third optional feeder 2, i.e., the optional feeder 2 connected below the second optional feeder 2, the moving amount of the sliding member 4 equals 2×P (two pitches of unique numbers on the sliding member 4). Accordingly, the unique number "4" is displayed in the display window of the third optional feeder 2.

As described above, because the moving amount of the sliding member 4 differs among the optional feeders 2 by a quantity of multiples of the pitch of the unique display, the unique display differs among the optional feeders 2. Accordingly, the unique display of the optional feeder 2 is displayed as "2", "3" and "4" starting from the uppermost optional feeder 2, so that the respective optional feeders 2 can be discriminated as sheet-feeding-unit numbers "2", "3" and "4".

In the first embodiment, the height of the display base 3 is set so that the lower surface of the sliding member 4 substantially contacts the bottom of the display base 3 at a position where the sliding member 4 is slid downward by two pitches of unique numbers, in a state in which two optional feeders 2 are stacked above. Accordingly, when stacking the optional feeders 2 in at least four stages, the projection 9 cannot be inserted into the upper optional feeder 2, and the optional feeder 2 in at least four stages from bottom cannot correctly be mounted. That is, when not intending to stack the optional feeders 2 in at least four stages, this configuration can be adopted.

When stacking the optional feeders in at least four stages, by setting the number of characters formed in the sliding member 4 to the largest necessary number of optional feeders to be stacked, and forming the sliding member 4 to a size satisfying the above-described equation (1), the optional feeders can be stacked in a necessary number of stages. When stacking the optional feeders 2, a unique identifier is automatically displayed in the display window of the corresponding optional feeder.

As described above, by adopting the configuration of the first embodiment, it is possible to reduce the moving amount of the sliding member 4 necessary for switching the unique display, reduce the height of unique-display switching means, and stack a large number of optional apparatuses having a small height H.

The configuration of the unique-number display unit of the first embodiment may be applied to an optional tray to be described below.

Second Embodiment

Figure 4:
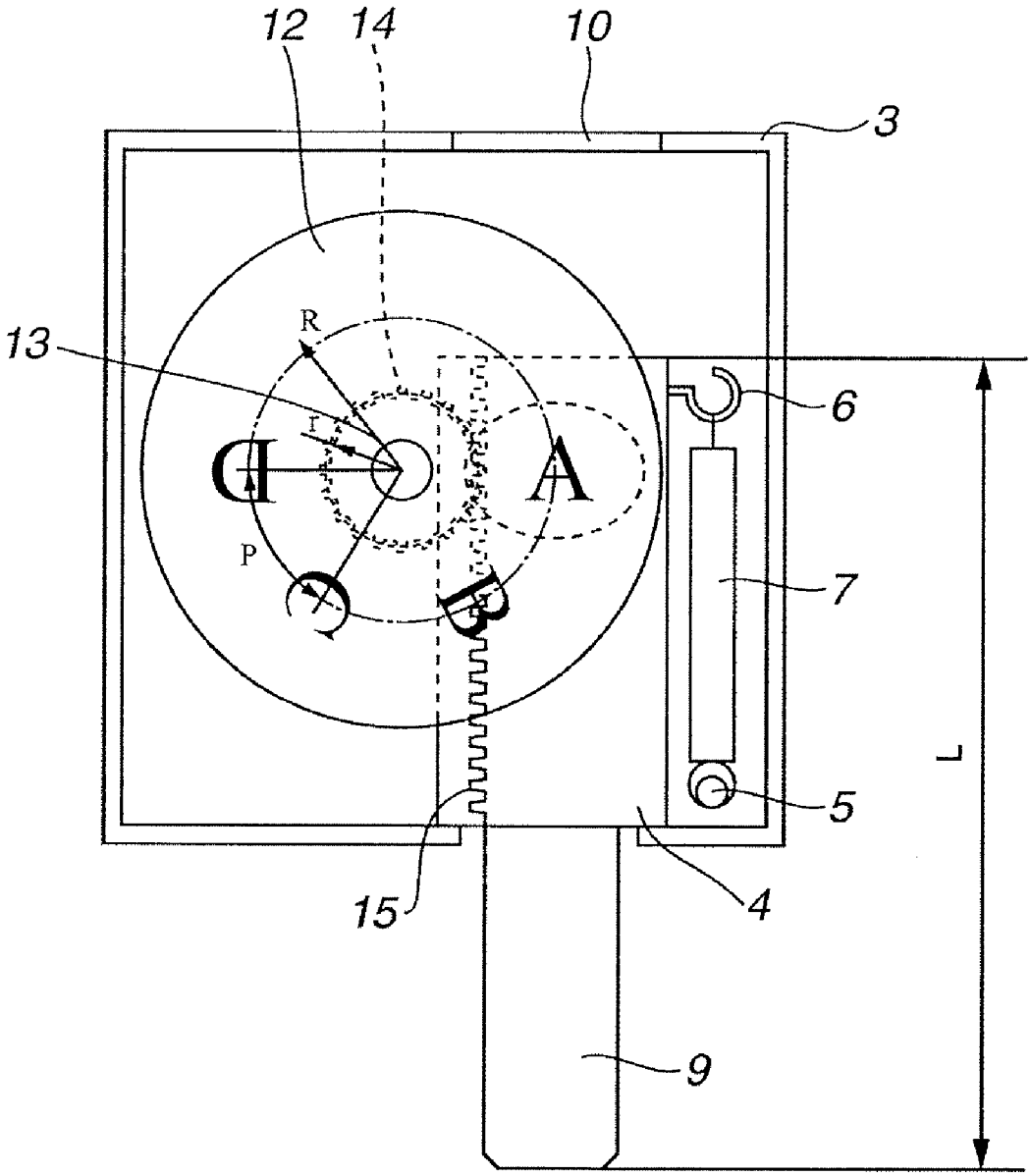
FIG. 4 is a cross-sectional view illustrating a unique numeric identifier unit of an optional apparatus according to a second embodiment of the present invention.
Figure 5:
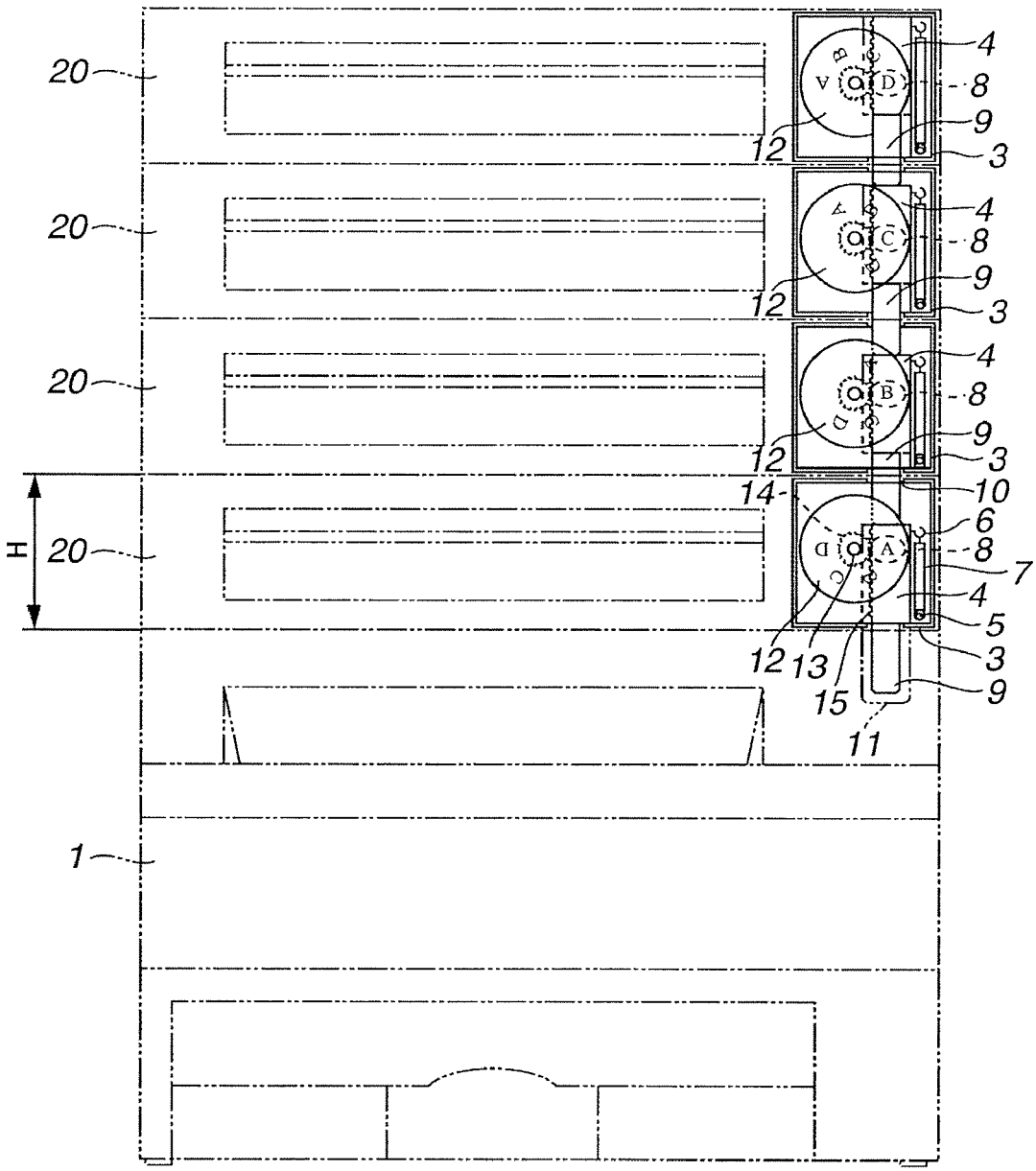
FIG. 5 is a cross-sectional view illustrating peculiar-number display units of optional apparatuses according to the second embodiment.
Figure 6:
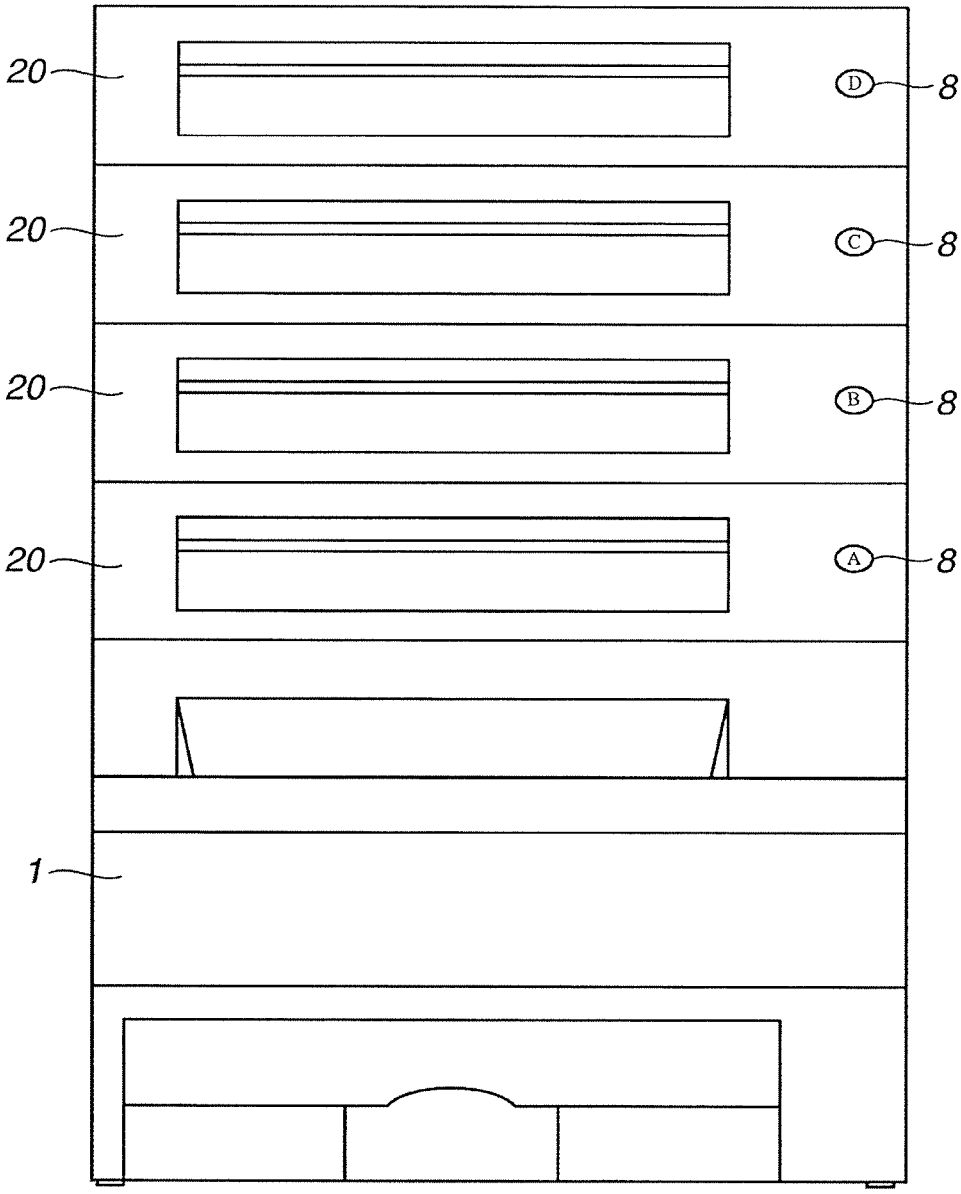
FIG. 6 is a front view illustrating an image forming apparatus and external sheet feeding apparatuses according to the second embodiment.
Figure 7:
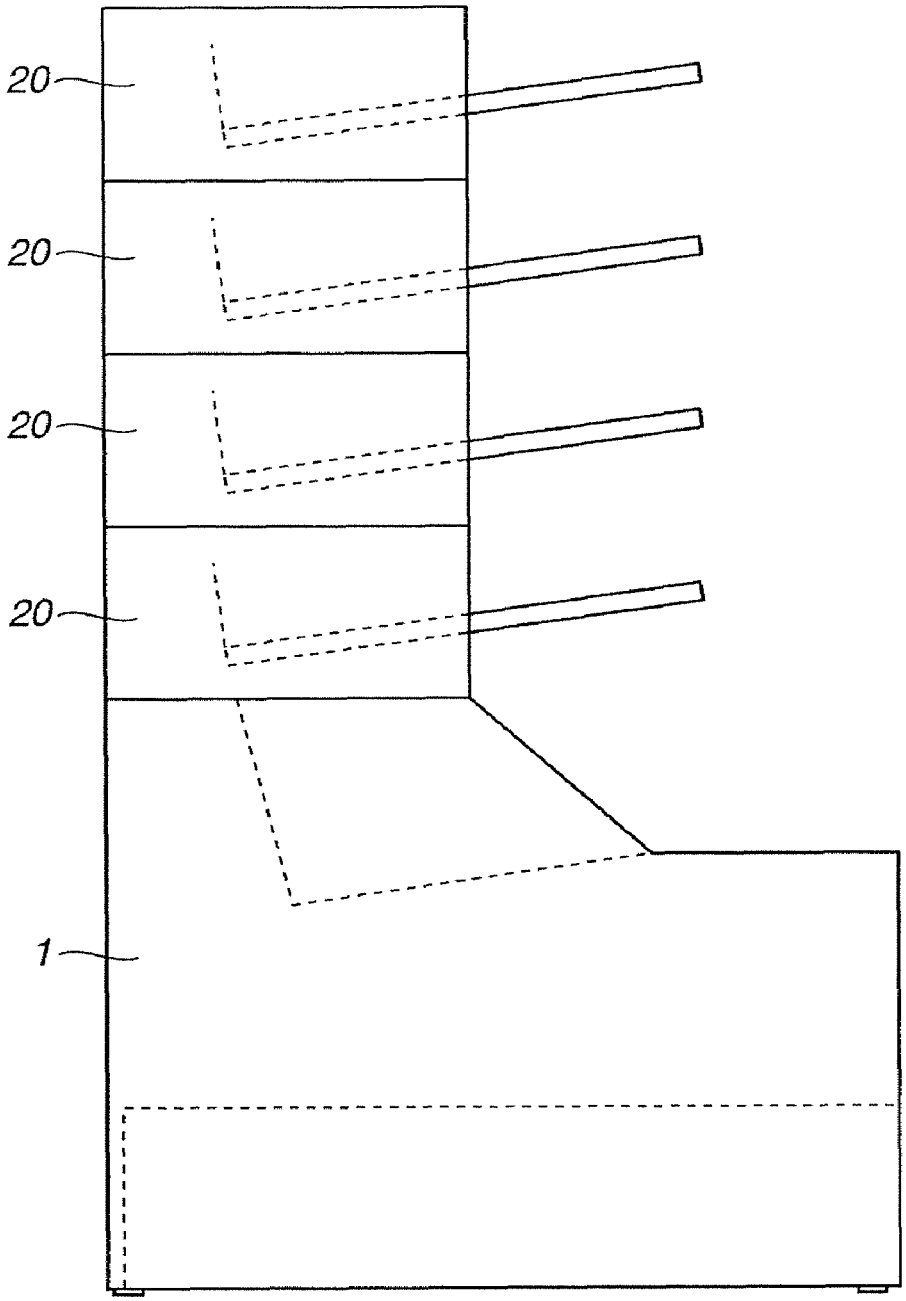
FIG. 7 is a side view illustrating the image forming apparatus and the external sheet feeding apparatuses according to the second embodiment.
Figure 8:
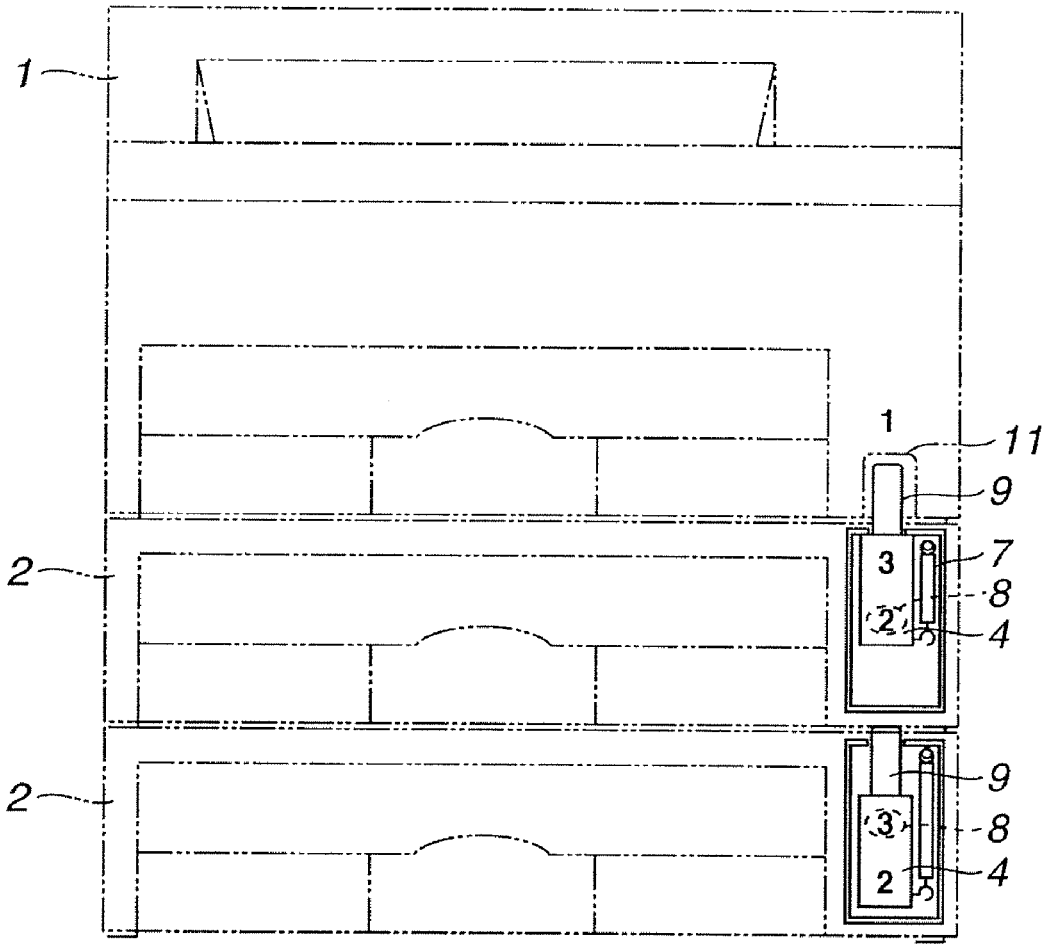
FIG.8 PRIOR ART
FIG. 8 is a front view illustrating a conventional image forming apparatus and external sheet feeding apparatuses.

A second embodiment of the present invention will now be described in detail with reference to FIGS. 4-7. FIG. 4 is a detailed cross-sectional view illustrating a unique-number display unit according to the second embodiment. FIG. 5 is a cross-sectional view illustrating a state of stacking optional trays, serving as optional apparatuses. FIG. 6 is a front view illustrating an image forming apparatus to which the optional trays are connected. FIG. 7 is a side view of the image forming apparatus and the optional trays. Components corresponding to those in the first embodiment will be indicated by the same reference numerals, and the description will be omitted for components having the same functions as those in the first embodiment.

The second embodiment differs from the first embodiment in that optional trays 20 capable of being stacked above an image forming apparatus are used, a display member 12 interlocked with a sliding member 4 is newly adopted, and alphabetical characters are adopted for unique displays of the optional trays 20.

The optional tray 20 is for discharging a sheet on which an image has been formed in an image forming apparatus 1, and can hold a large number of discharged sheets, or hold discharged sheets by selectively sorting the sheets.

In FIG. 4, a sliding member 4 is held on a display base 3 fixed on the frame of the optional tray 20 so as to be vertically slidable, and is urged downward by a coil spring 7. A projection 9 of the sliding member 4 is integrally formed at a lower portion of a display unit, and protrudes from a lower portion of the optional tray 20.

A hole 10 through which the projection 9 of the sliding member 4 of an optional tray 20 to be connected above can be inserted is provided in the upper surface of the optional tray 20 and the upper surface of the display base 3 at a position facing the projection 9. When another optional tray 20 is connected above, the projection 9 of the sliding member 4 of this optional tray 20 is inserted into the hole 10 of the lower optional tray 20, so as to contact the upper surface of the display unit of the sliding member 4 of the lower optional tray 20.

A rack 15 parallel to the sliding direction of the sliding member 4 is integrally formed in the sliding member 4. A disk-shaped display unit 12 is rotatably held around a shaft 13 integrally formed with the display base 3 at a side of the sliding member 4. Characters "A", "B", "C" and "D", serving as unique displays of the optional trays 20, are integrally formed on the surface of the display member 12 on a circle having a radius of R around the shaft 13 by being arranged with a circular pitch of P.

A pinion 14 having a pitch-radius circle r and concentric with the shaft 13 is integrally formed on a back of the display member 12 opposite to the surface having the characters, and meshes with the rack 15 formed at the sliding member 4.

When the moving amount of the sliding member 4 necessary for rotating the display member 12 around the shaft 13 by an amount of the pitch P is represented by m, m is obtained according to the following equation (2), from the relationship between the pitch-circle radius R of the circle where unique letters are arranged and the pitch-circle radius r of the pinion 14:

$$m=P\times r/R \quad (2).$$

In the second embodiment, when the length from the lower end of the projection 9 to the upper end of the sliding member 4 is represented by L, and the moving amount of the sliding member 4 necessary for rotating the display unit 12 by an amount of the pitch P is represented by m, and H is the height of optional tray 20, the sliding member 4 is set so as to satisfy the following equation (3):

$$L=H+m \quad (3).$$

A hole 11 through which the projection 9 can be inserted is provided in the upper surface of the image forming apparatus 1 at a position facing the projection 9 of an optional tray 20 to be connected above. In the case of the optional tray 20 connected above the image forming apparatus 1, since the projection 9 is completely inserted into the hole 11 of the image forming apparatus 1, the sliding member 4 does not move. Accordingly, the unique letter display "A" is displayed in a display window 8 of the optional feeder 20 to which the image forming apparatus 1 is directly connected.

When further connecting another optional tray 20, the projection 9 of the optional tray 20 to be disposed above enters the hole 10 of the lower optional tray 20 and contacts the upper surface of the sliding member 4 of the lower optional tray 20, to be pushed upward against the spring force of the coil spring 7.

When the optional tray 20 connected below is in one stage, the moving amount of the sliding member 4 is m in the above-described Equation (3). As described with reference to Equation (2), the display member 12 is rotated by one pitch of the unique display in accordance with the movement of the sliding member 4. Accordingly, the unique display "B" is displayed in the display window 8 of the optional tray 20.

When the optional trays 20 are connected below in two stages, the moving amount of the sliding member 4 is 2×m. According to Equation (2), the display member 12 is rotated by two pitches of the unique display in accordance with the movement of the sliding member 4. Accordingly, the letter "C" is displayed in the display window 8 of the optional tray 20.

Similarly, when the optional trays 20 are connected below in three stages, the moving amount of the sliding member 4 is 3×m, and the letter "D" is displayed in the display window 8 of the optional tray 20.

As described above, the unique displays of the respective optional trays 20 are displayed as "A", "B", "C" and "D" starting from the lowest tray, and the respective optional trays can be discriminated as sheet-discharging-unit numbers "A", "B", "C" and "D".

By thus connecting the optional trays 20 upward, the unique letter displayed in the display window 8 is automatically switched. When stacking the optional trays 20 in at least five stages, by setting the number of characters to be formed on the display member 12 to the maximum necessary number of stacked trays, and forming the sizes of the projection 9 and the sliding member 4 so as to satisfy the above-described Equations (2) and (3), the necessary number of stacked trays can be obtained.

That is, by appropriately setting the relationship between the radius R of the pitch circle where unique displays are arranged and the pitch-circle radius r of the pinion 14, the moving amount of the unique display can be set to a value larger than the moving amount of the sliding member 4. Accordingly, although when the number of connected optional trays 20 is increased, the moving amount of the sliding member 4 for switching is reduced, the moving amount of the display can be increased. Hence, it is unnecessary to reduce the size of the display.

The configuration of the unique identifier display unit of the second embodiment may also be applied to the optional feeder in the first embodiment. Although in the foregoing embodiments, numerals and alphabets are used as the peculiar numbers, any other appropriate display may be used, provided that respective optional apparatuses can be discriminated.

The individual components shown in outline in the drawings are all well known in the optional apparatus and image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims.

What is claimed is:

1. A plurality of connected optional apparatuses, each comprising:

a sliding member slidable in a direction of connection, wherein said sliding member is directly connected with a sliding member of an adjacent one of said plurality of optional apparatuses; and a display member rotatably held around a shaft and connected to said sliding member, said display member containing a plurality of unique identifiers, wherein, when said plurality of optional apparatuses are connected, and the sliding members are connected, a moving amount of said sliding member of each of said plurality of optional apparatuses differs from each other of optional apparatuses, and a rotational amount of the display member of each optional apparatus differs from each other of optional apparatuses, thereby displaying a different unique identifier of the display member of each optional apparatus.

2. A plurality of connected optional apparatuses according to claim 1, wherein a pinion is provided on the shaft and is integrally formed on the display member, and a rack is provided on the sliding member and meshes with the pinion, thereby rotating the display member according to a sliding movement of the sliding member.

3. A plurality of connected optional apparatuses according to claim 1, wherein the plurality of unique identifiers are arranged on said display member at a constant circular pitch, and wherein, when a circular pitch between adjacent unique identifiers is represented by P, a pitch-circle radius of the unique identifiers is represented by R, and a pitch-circle radius of the pinion is represented by r, the moving amount of the sliding member necessary for rotating the display member around the shaft by an amount of the pitch P is represented by m, m is obtained according to the following equation:

$$m=P\times r/R$$

when a total length of said sliding member is represented by L and a length of each of said plurality of optional apparatuses in the direction of connection is represented by H, the following relationship is satisfied:

$$L=H+m.$$

4. A plurality of connected optional apparatuses according to claim 1, each further comprising a projection and a spring for urging said projection in its projecting direction from each of said plurality of optional apparatuses, wherein said projection is contactable with a sliding member of an adjacent one of said plurality of optional apparatuses.

5. An image forming apparatus comprising:

a main body of said image forming apparatus; and a plurality of optional apparatuses connected to said main body, each optional apparatus comprising a sliding member slidable in a direction of connection, wherein said sliding member is directly connected with a sliding member of an adjacent one of said plurality of optional apparatuses; and a display member rotatably held around a shaft and connected to said sliding member, said display member containing a plurality of unique identifiers on a circle around the shaft, wherein, when said plurality of optional apparatuses are connected, and the sliding members are connected, a moving amount of said sliding member of each of said plurality of optional apparatuses differs from each other of optional apparatuses, and a rotational amount of the display member of each optional apparatuses differs from each other of optional apparatuses, thereby displaying a different unique identifier of the display member of each optional apparatus.

6. A plurality of connected optional apparatuses according to claim 5, wherein a pinion is provided on the shaft and is integrally formed on the display member, and a rack is provided on the sliding member and meshes with the pinion, thereby rotating the display member according to a sliding movement of the sliding member.

7. A plurality of connected optional apparatuses according to claim 5, wherein the plurality of unique identifiers are arranged on said display member at constant circular pitch, and wherein, when a circular pitch between adjacent unique identifiers is represented by P, a pitch-circle radius of the unique identifiers is represented by R, and a pitch-circle radius of the pinion is represented by r, the moving amount of the sliding member necessary for rotating the display member around the shaft by an amount of the pitch P is represented by m, m is obtained according to the following equation:

$$m=P\times r/R$$

when a total length of said sliding member is represented by L and a length of each of said plurality of optional apparatuses in the direction of connection is represented by H, the following relationship is satisfied:

$$L=H+m.$$

8. An image forming apparatus according to claim 5, each further comprising a projection and a spring for urging said projection in its projecting direction from each of said plurality of optional apparatuses, wherein said projection is contactable with a sliding member of an adjacent one of said plurality of optional apparatuses.

9. An image forming apparatus according to claim 5, wherein said plurality of optional apparatus are optional feeders for supplying the image forming unit provided in said main body of said image forming apparatus with sheets.

10. An image forming apparatus according to claim 5, wherein said plurality of optional apparatus are optional trays for mounting and accommodating sheets on which an image has been formed by the image forming unit provided in said main body of said image forming apparatus.

* * * * *